US006565240B1

(12) United States Patent
Wu

(10) Patent No.: US 6,565,240 B1
(45) Date of Patent: May 20, 2003

(54) LAMP CONNECTING DEVICE CAPABLE OF BEING ASSEMBLED BY USERS

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/046,040

(22) Filed: Jan. 15, 2002

(51) Int. Cl.[7] ..... F21S 8/06; F21V 19/00
(52) U.S. Cl. ..... 362/405; 362/249; 362/457
(58) Field of Search ..... 362/226, 249, 362/405, 406, 429, 430, 457; 248/344

(56) References Cited

U.S. PATENT DOCUMENTS 1,059,742 A * 4/1913 Lumley ..... 362/405
1,062,619 A * 5/1913 Trood ..... 248/344
4,709,313 A * 11/1987 Goralnik ..... 362/405
4,748,549 A * 5/1988 Scheer ..... 362/406
5,475,578 A * 12/1995 Sevack et al. ..... 362/405
6,283,619 B1 * 9/2001 Pulaski et al. ..... 362/405
6,422,722 B1 * 7/2002 Voltolina ..... 362/405

* cited by examiner

*Primary Examiner*—Alan Cariaso

(57) ABSTRACT

A lamp connecting device is capable of being assembled by users for connecting a lamp seat and a lamp rod of one of a suspending lamp, a wall installed lamp, a table lamp and a ceiling lamp. The lamp seat and the lamp rod are detachable so as to have a smaller space for storage. A retaining seat is fixed by a retaining sleeve through a fixing hole of the lamp seat. A conductive plug or receptacle is installed in the retaining seat. The lamp rod is connected with an inserting sleeve. The power wire in the lamp rod is connected to the conductive plug or receptacle as the inserting sleeve passes through the retaining sleeve. The user may assemble the lamp seat and lamp rod by himself (or herself). Before assembly, the lamp seat and lamp rod can be detached for reducing the storage space and thus decreasing cost.

10 Claims, 11 Drawing Sheets

LAMP CONNECTING DEVICE CAPABLE OF BEING ASSEMBLED BY USERS

BACKGROUND OF THE INVENTION

1. Field of the Invention

The present invention relates to a lamp connecting device, and particularly to a lamp connecting device capable of being assembled by users, wherein the user may assemble the lamp seat and lamp rod by himself (or herself). Before transferring, the lamp seat and lamp rod can be detached for reducing the storage space and decreasing cost.

2. Description of Related Art

Prior wire connection devices of lamps, such as wall lamps, stand type lamps, and ceiling lamps, use studs and nuts to lock the components. In assembly, not only the user is easy to be harmed, but also other locking tools (such as spanners, openers, etc.) are necessary. Moreover, in assembly, electric wires are easy to expose out and some dangers are induced. Thereby, the prior art is not suitable to be assembled by the user himself (or herself). In general, since in the prior art design, the wire is possibly exposed out if the assembly work is performed by the user, the manufacturer assembles the device in advance, namely, the wire box is assembled with inserting rods in the manufacturing process. However, this will induce that a large space is required for transferring and storing and thus cost is increased.

SUMMARY OF THE INVENTION

Accordingly, the primary object of the present invention is to provide a lamp connecting device capable of being assembled by users for connecting a lamp seat and a lamp rod of one of a suspending lamp, a wall installed lamp, a table lamp and a ceiling lamp; the lamp seat and lamp rod being detachable so as to have a smaller space for storage.

Another object of the present invention is to provide a lamp connecting device, wherein by a regular or irregular polygonal hole to engage a regular or irregular polygonal inserting surface. Thereby, the user may assemble the lamp seat and lamp rod by himself (or herself). Before transferring the present invention, the lamp seat and lamp rod can be detached for reducing the storage space and decreasing cost.

A further object of the present invention is to provide a lamp connecting device capable of being assembled by users, wherein the lamp rod is inserted into the lamp seat from the upper side or lateral sides thereof as desired.

To achieve above objects, the present invention provides a lamp connecting device capable of being assembled by users for connecting a lamp seat and a lamp rod. The device comprises the following components:

A lamp seat is formed with a plurality of fixing holes for positioning a plurality of retaining sleeves.

A retaining sleeve is installed to one of a lateral side and an upper side of a lamp. The retaining sleeve has threads and has a stop ring or a confining stopper which has an outer diameter larger an outer diameter of the thread. Thereby, the retaining sleeve is locked to a fixing hole by a positioning nut. The retaining sleeve has a polygonal inserting hole.

A retaining seat is engaged to a retaining sleeve, and is positioned at a predetermined position of a rear side of the retaining sleeve.

An inserting sleeve has a rear end connected to the lamp rod. The connection of the inserting sleeve and the lamp rod are installed with a stepped ring for resisting against a fixing nut or an annular trench for confining a stud. A front end of the inserting sleeve is inserted by a conductive plug or a conductive receptacle. An inserted surface of the inserting rod for inserting into the inserting hole of the retaining sleeve has a shape corresponding to a shape of the inserting hole;

The various objects and advantages of the present invention will be more readily understood from the following detailed description when read in conjunction with the appended drawing.

DETAILED DESCRIPTION OF THE PREFERRED EMBODIMENTS

Figure 1:
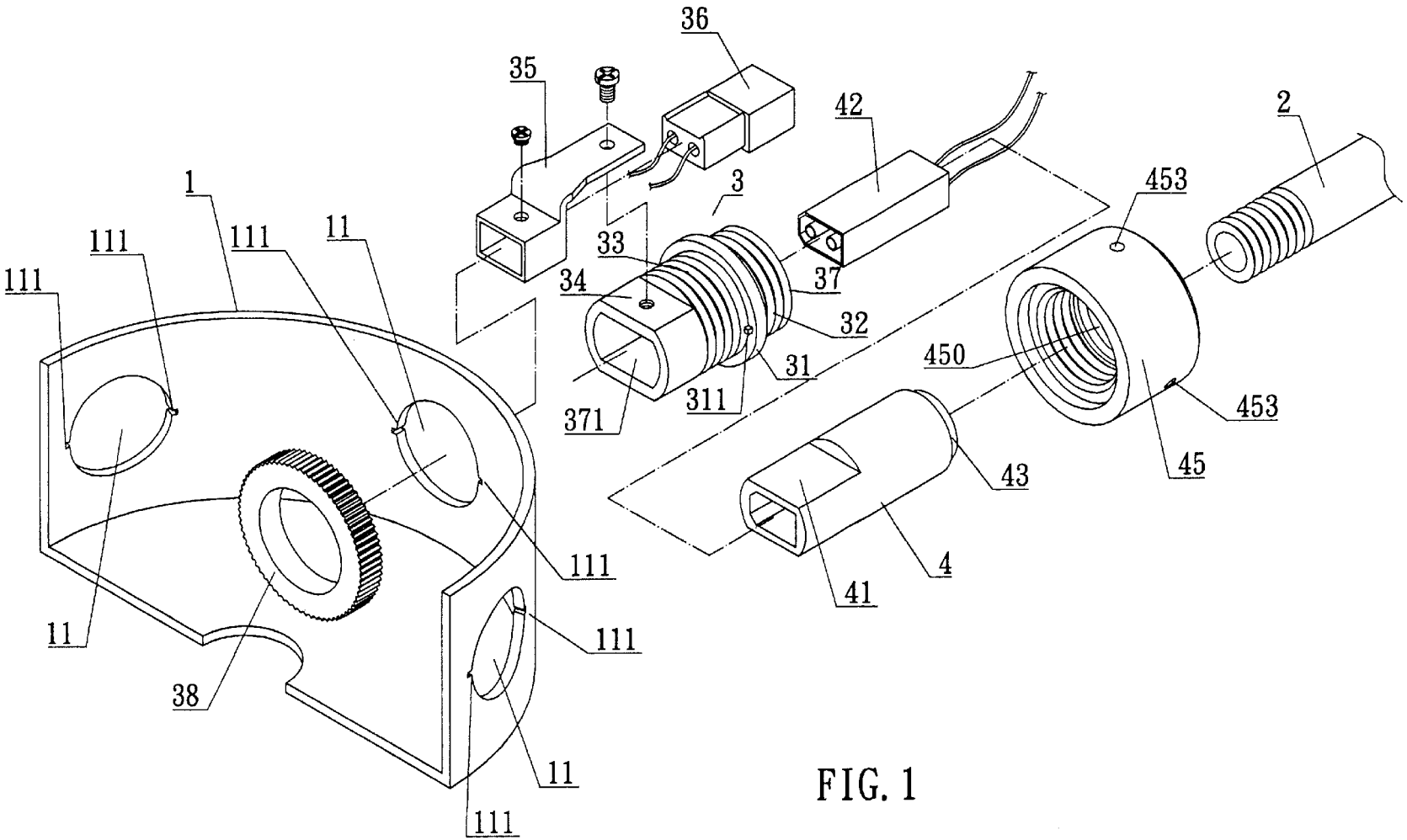
FIG. 1 is an exploded perspective view of the first embodiment of the present invention.
Figure 1A:
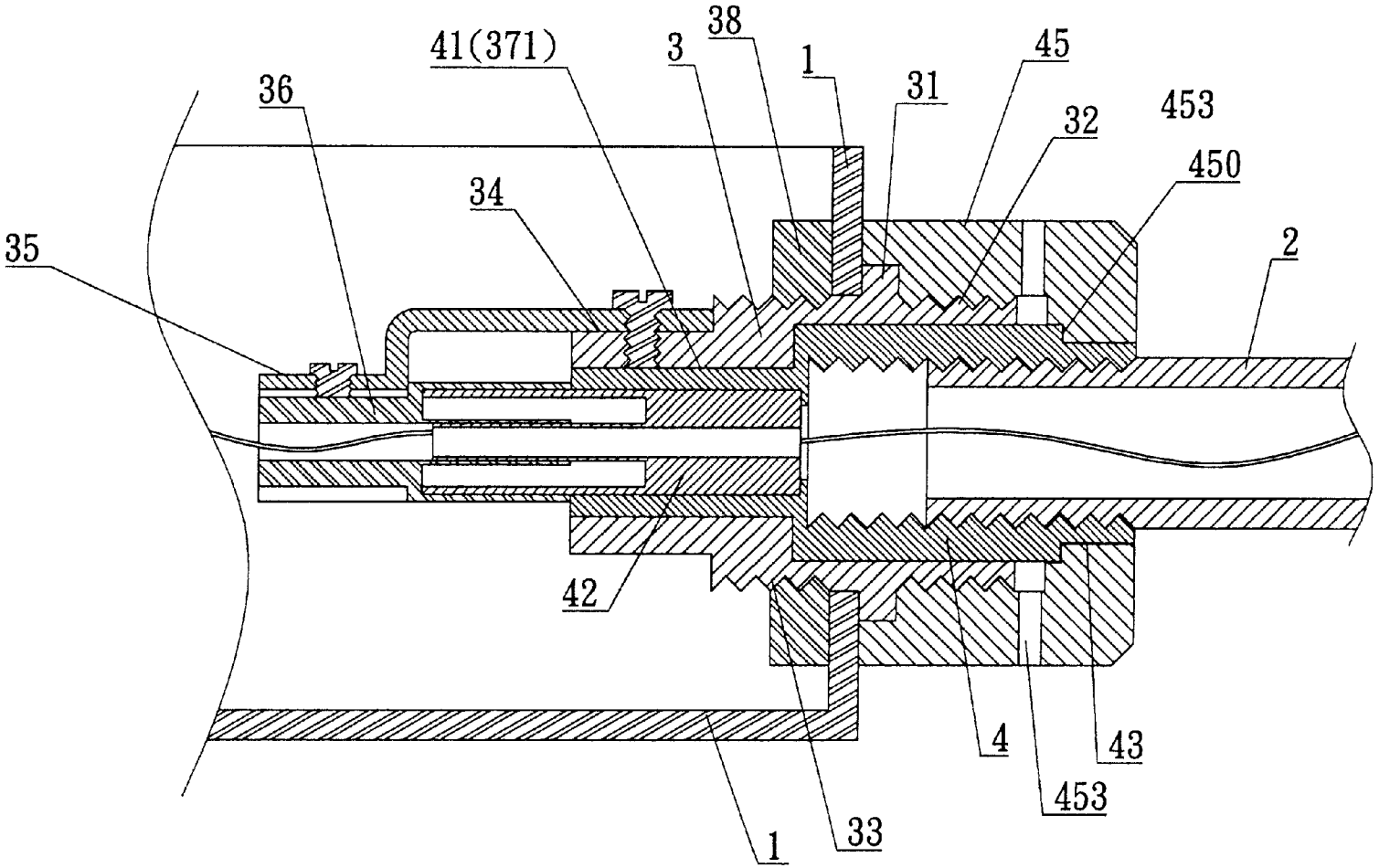
FIG. 1A is an assembled cross sectional view of the first embodiment of the present invention.

Referring to FIGS. 1 and 1A, the lamp seat 1 and lamp rod 2 are separated. The lamp rod 2 can be inserted into the lamp seat 1 so that both the lamp rod 2 and lamp seat 1 are conductive. The lateral side or the upper side of the lamp seat 1 (referring to FIGS. 5B and 5C) are formed with a plurality of fixing holes 11 and the edge of each fixing hole 11 is formed with positioning notches 111.

A retaining sleeve 3 has a stop ring 31 at a middle section thereof. One lateral surface of the stop ring 31 has a plurality of blocks 311 at positions corresponding to the positioning notches 111 of the fixing hole 11. The front and rear sections of the stop ring 31 are formed with threads 32, 33. A retaining section 34 is adjacent to the rear thread 34. Thereby, a retaining seat 35 can be fixed to the retaining section 34. A conductive receptacle or a plug 36 can be engaged and fixed to the retaining section 34. An inserting hole 37 is formed in the retaining sleeve 3, which can be a regular or irregular polygonal hole 371. The retaining sleeve 3 passes through the fixing hole 11 of the lamp seat 1 . The blocks 311 are exactly engaged with the positioning notches 111 of the fixing hole 11. Then a positioning screw 38 serves to lock the rear thread of the retaining sleeve 3. Thereby, the retaining sleeve 3 is firmly secured to the fixing hole 11 of the lamp seat 1. Then the conductive receptacle or plug 36 is installed at a rear side of the inserting hole 37 of the retaining sleeve 3.

A front end of the lamp rod 2 is connected to an inserting sleeve 4, and an outer edge thereof has a stepped ring 43. A part or whole of the inserting sleeve 4 is formed as a regular or irregular polygonal inserting surface 41 which is corresponding to the regular or irregular polygonal hole 371 of the inserted hole 37. A conductive plug or receptacle 42 is engaged into the inserting sleeve 4 so that the conductive plug or receptacle and the inserting sleeve 4 are combined as an integral body A fixing nut 45 has an end surface with a stepped ring surface 450. In front of the front thread 32 of the retaining sleeve 3, the stepped stop ring 43 can be pushed forwards for confining the retaining sleeve 3. Thereby, the inserting sleeve 4 and the retaining sleeve 3 can be combined steadily and are not separated with one another.

Figure 2:
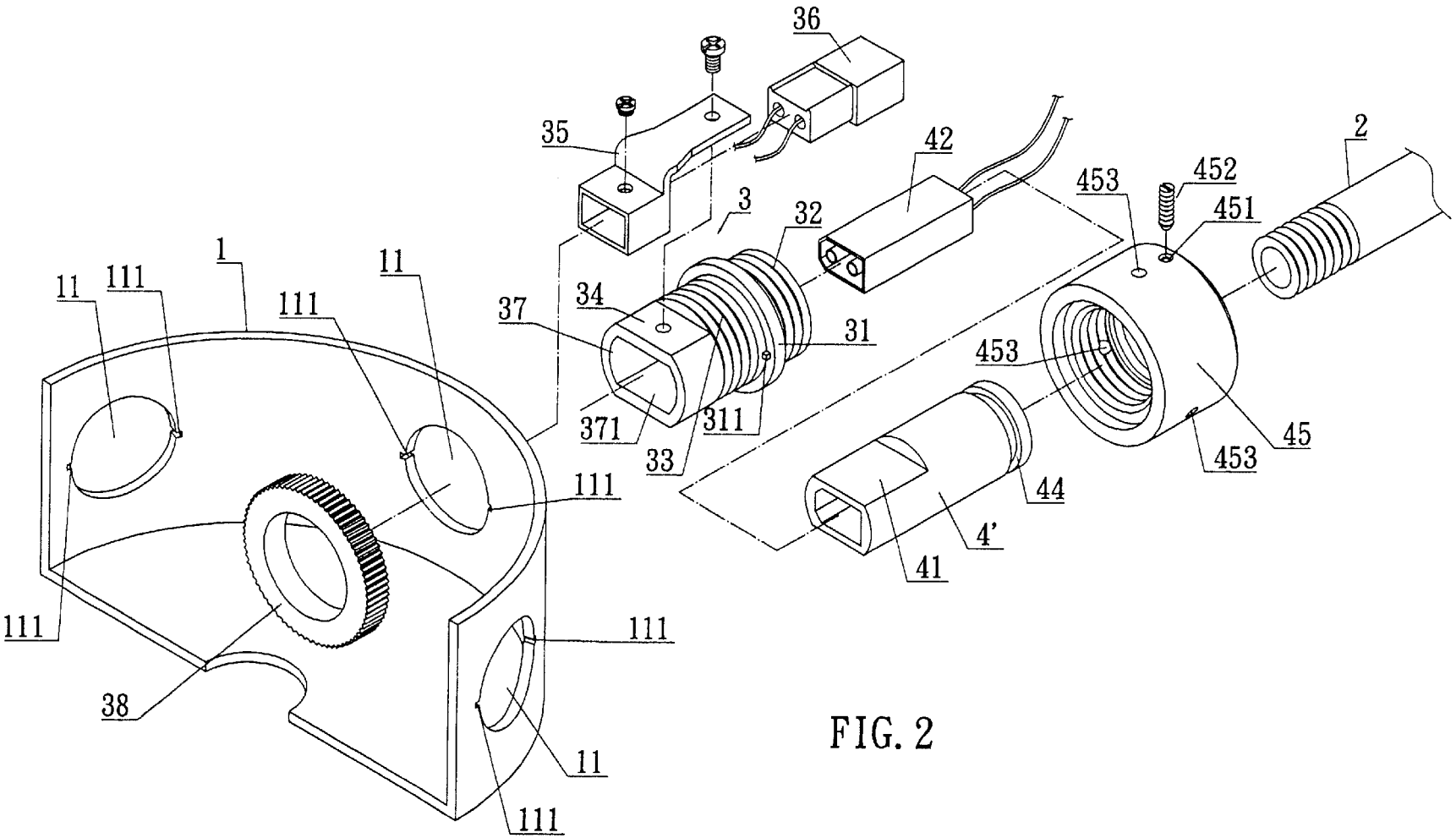
FIG. 2 is an exploded perspective view of the second embodiment of the present invention.
Figure 2A:
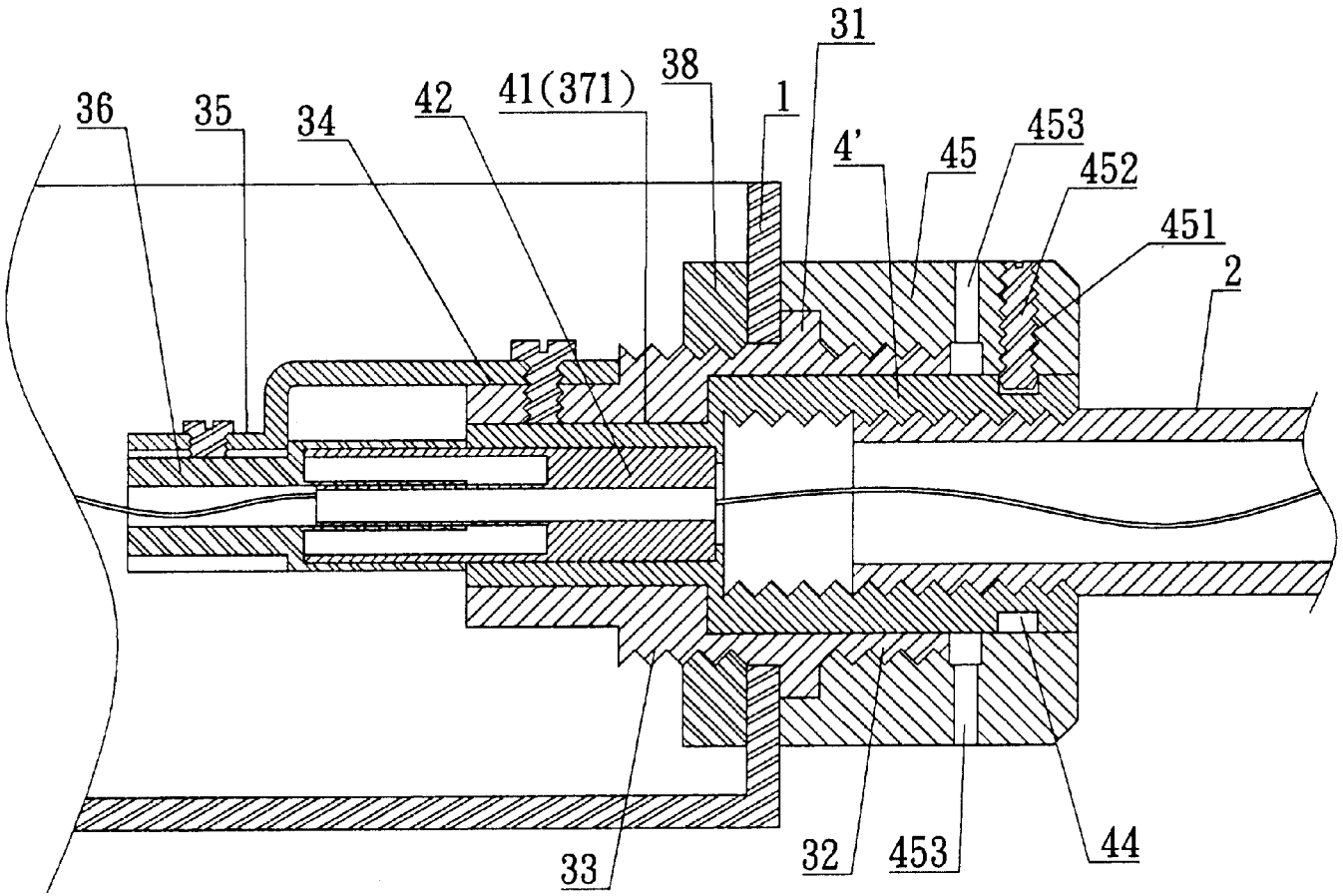
FIG. 2A is an assembled cross sectional view of the second embodiment of the present invention.

Referring to FIGS. 2 and 2A, the lamp seat 1, lamp rod 2, retaining sleeve 3, retaining seat 35, conductive plug or receptacle 36(42) and positioning nut 38 are unchanged. A front end of the inserting sleeve 4' is formed with a trench 44. The fixing nut 45 is formed with a vertical penetrating threaded hole 451. A stud 452 is locked into and passes through the screw hole 451 to loosely resist against the trench 44 of the inserting sleeve 4'. Thereby, the fixing nut 45 can rotate. Furthermore, when the fixing nut 45 is locked to the front thread 32 of the retaining sleeve 3, the inserting sleeve 4' can be confined in the retaining sleeve 3 so not to retract out. Then, by using the regular or irregular polygonal hole to engage the regular or irregular polygonal inserting surface 41, the lamp rod 2 will not rotate. Thereby, the user may assemble the lamp seat 1 and lamp rod 2 by himself (or herself). Further electric wires will not be damaged. Before transferring the present invention, the lamp seat 1 and lamp rod 2 can be detached for reducing the storage space and decreasing cost.

Figure 3:
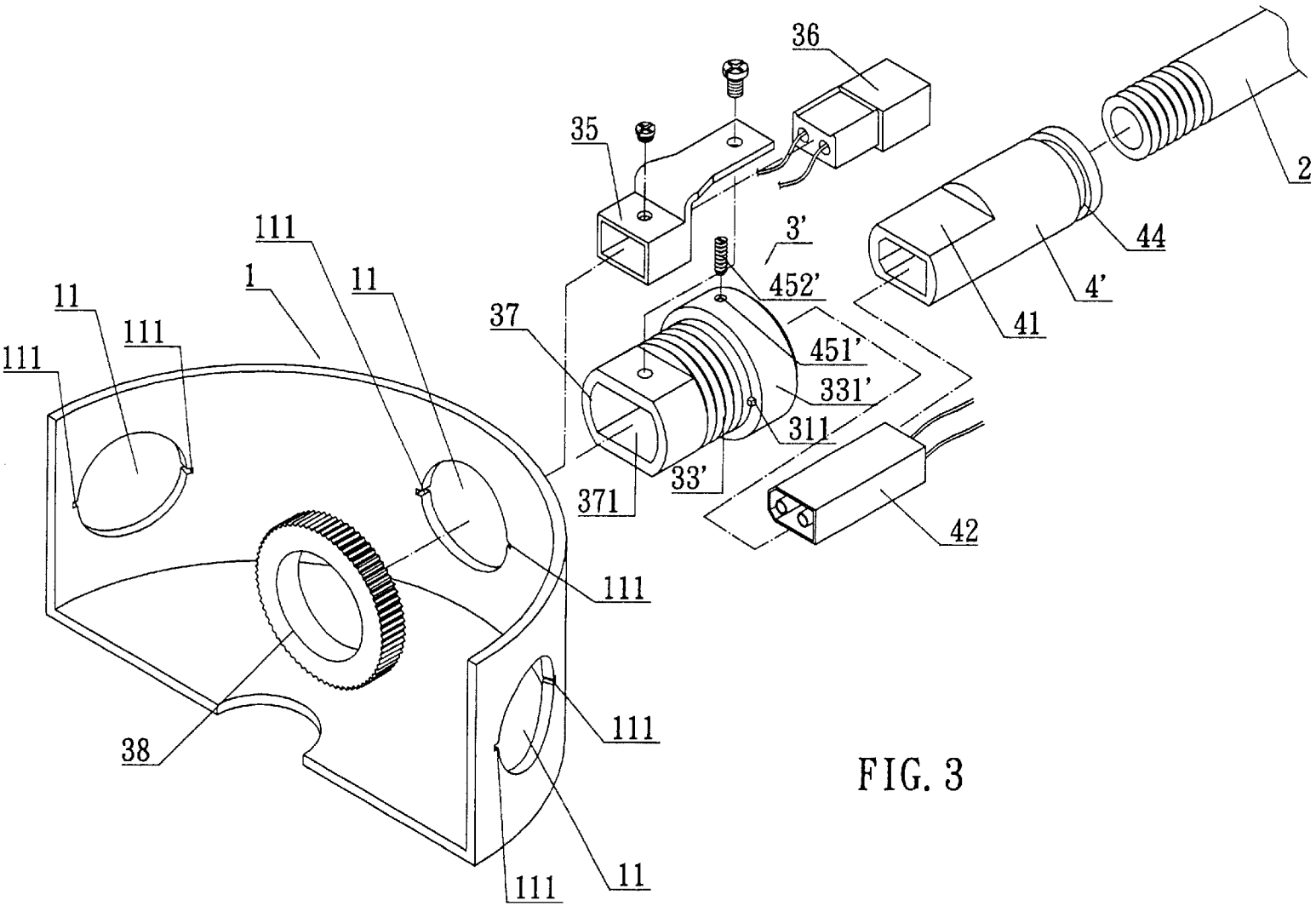
FIG. 3 is an exploded perspective view of the second embodiment of the present invention.
Figure 3A:
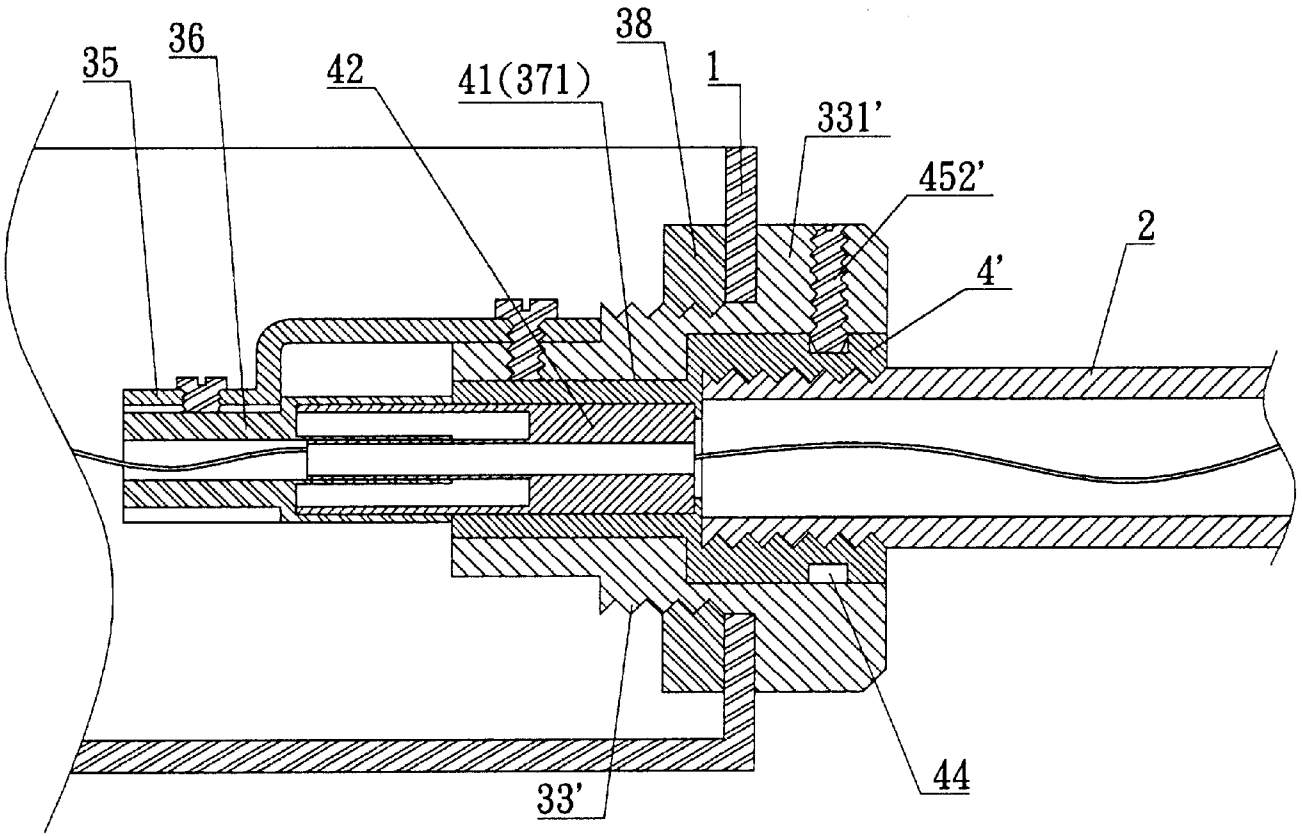
FIG. 3A is an assembled cross sectional view of the second embodiment of the present invention.

With reference to FIGS. 3 and 3A, in this embodiment, the lamp seat 1, lamp rod 2, retaining sleeve 3, retaining seat 35, conductive plug or receptacle 36(42), positioning nut 38 and inserting sleeve 4' are remained. The retaining sleeve 3 and the fixing nut 45 (referring to FIG. 2) are integrally formed to be as a retaining sleeve 3'. The inserted hole 37 has an above mentioned regular or irregular polygonal hole 371 so that the rear thread 33' of the retaining sleeve 3 is directly connected to the confining stopper 331'. A vertical penetrating threaded hole 451' is formed in a predetermined position on the confining stopper 331'. Then a stud 452' passes through the threaded hole 451' and then exactly resists against the trench 44 of the inserting sleeve 4 so that the inserting sleeve 4' will retract out. Thereby, the present invention can be assembled rapidly.

Figure 4A:
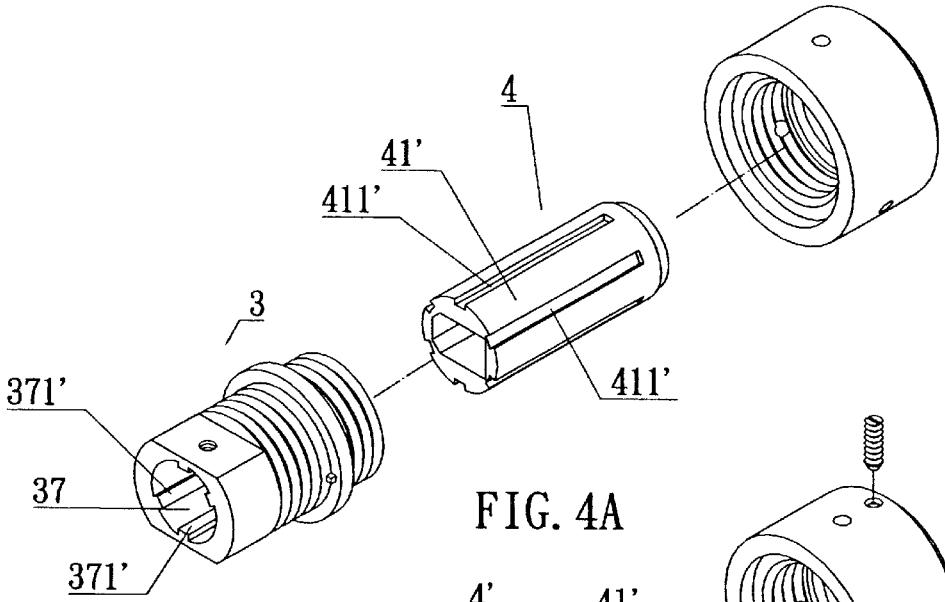
FIG. 4A is an application showing the inserting sleeve and the retaining sleeve of first embodiment of the present invention.
Figure 4B:
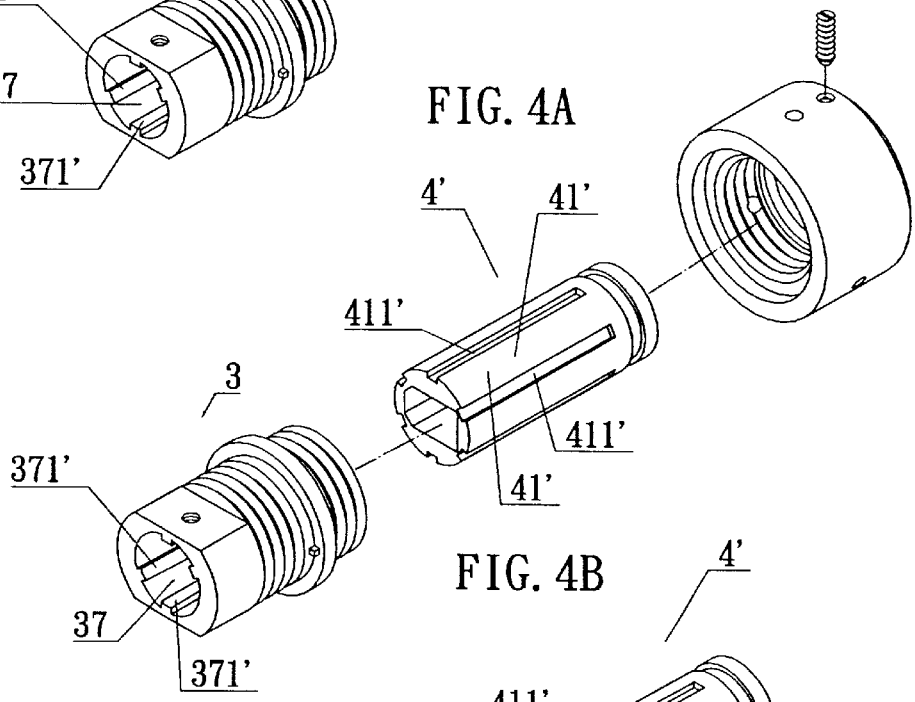
FIG. 4B is an application showing the inserting sleeve and the retaining sleeve of second embodiment of the present invention.
Figure 4C:
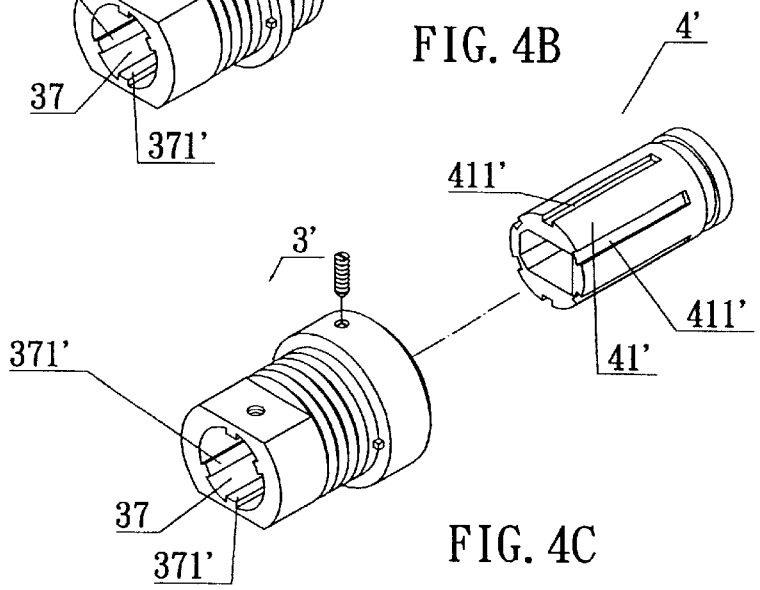
FIG. 4C is an application showing the inserting sleeve and the retaining sleeve of third embodiment of the present invention.

Referring to FIGS. 4A, 4B and 4C, the inner edges of the inserted hole 37 of the retaining sleeves 3, 3' and the inserting surface 41' of the inserting sleeves 4, 4', respectively, are formed with a plurality of sliding tracks 371' or sliding groove 411'. Thereby, when the retaining sleeves 3, 3' and the inserting sleeves 4, 4', respectively are engaged with one another, the retaining sleeves 3, 3' will not rotate.

Figure 5A:
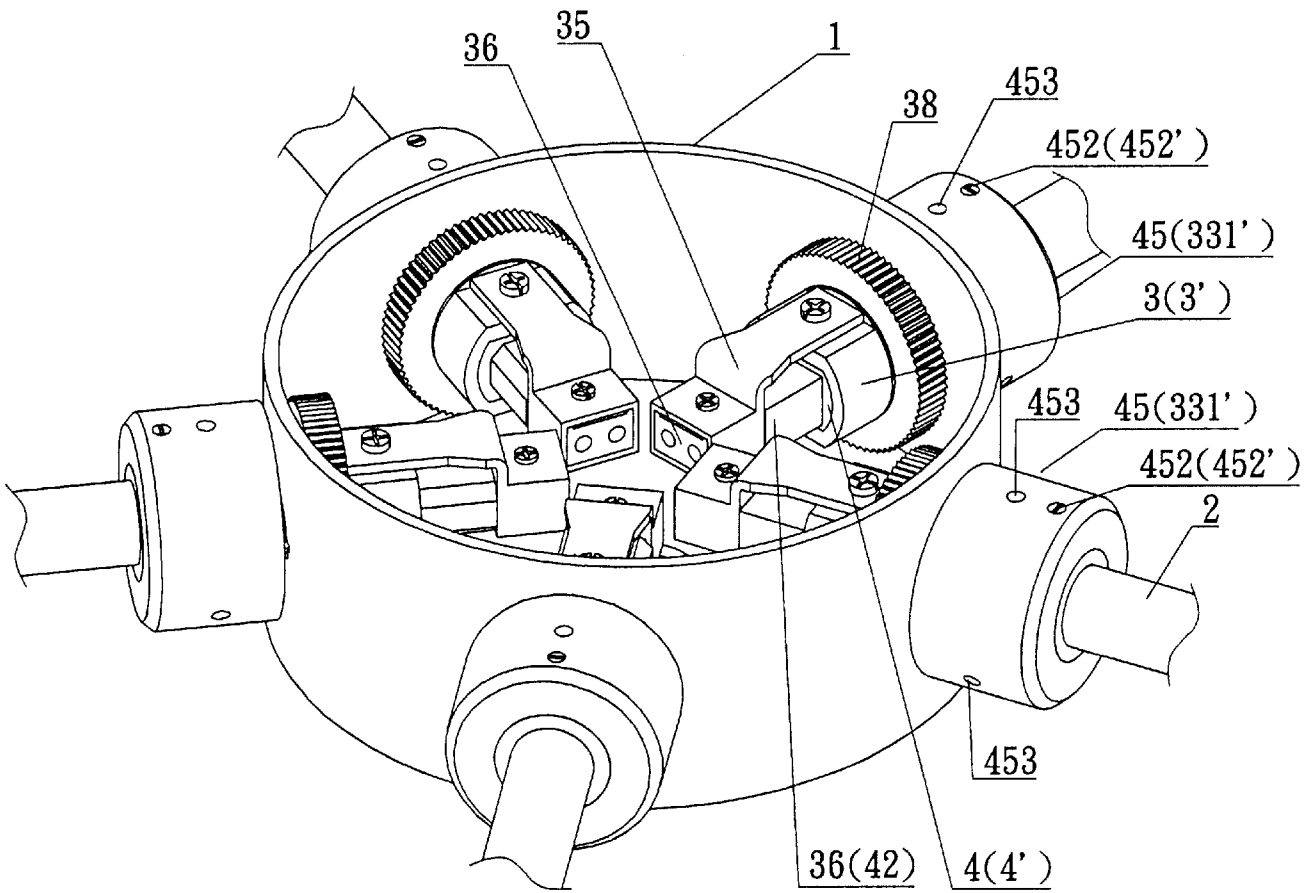
FIG. 5A is a schematic view showing an assembled perspective view of the present invention.
Figure 5B:
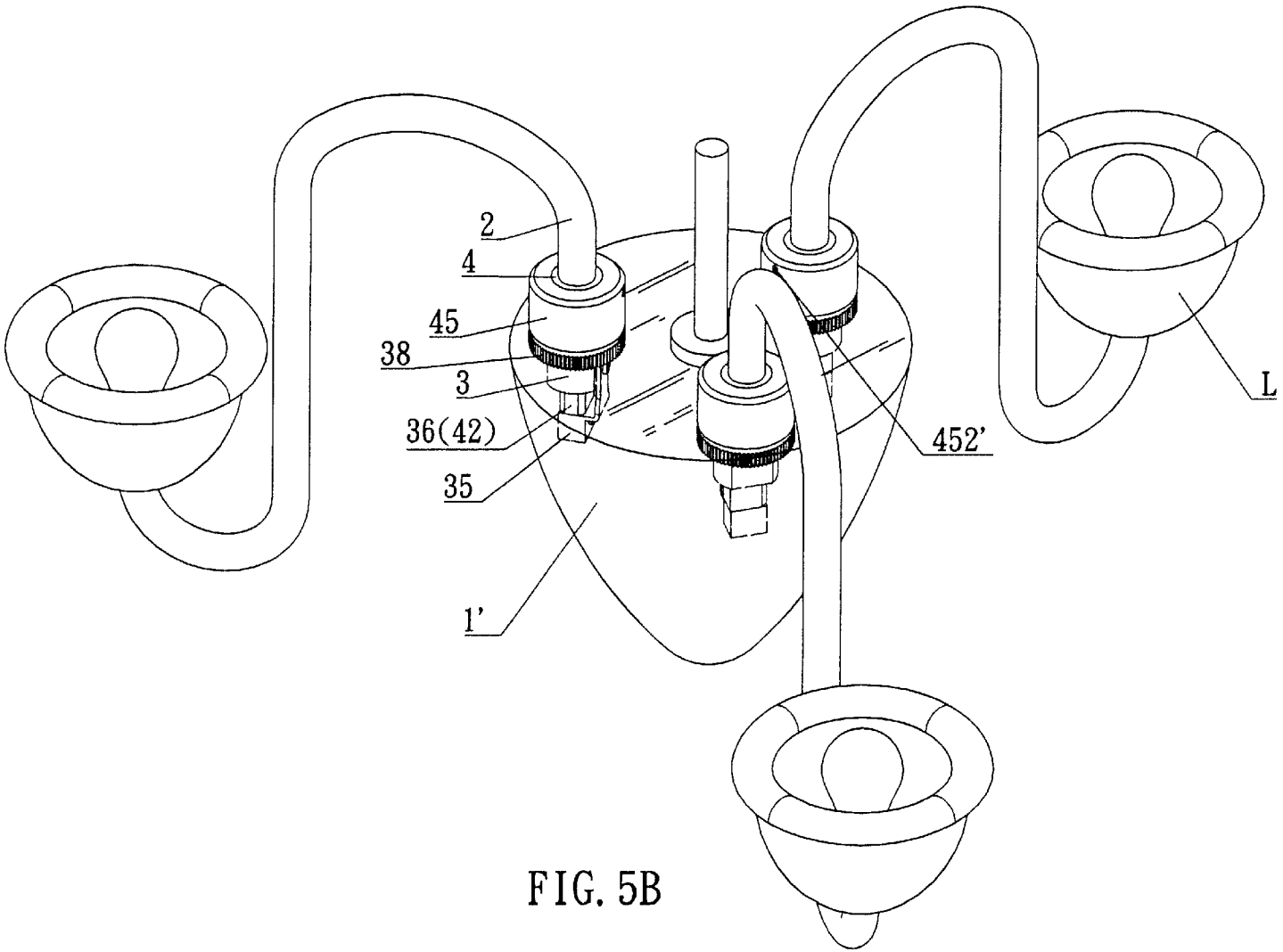
FIG. 5B is an assembled perspective view of the first embodiment of embodiment.
Figure 5C:
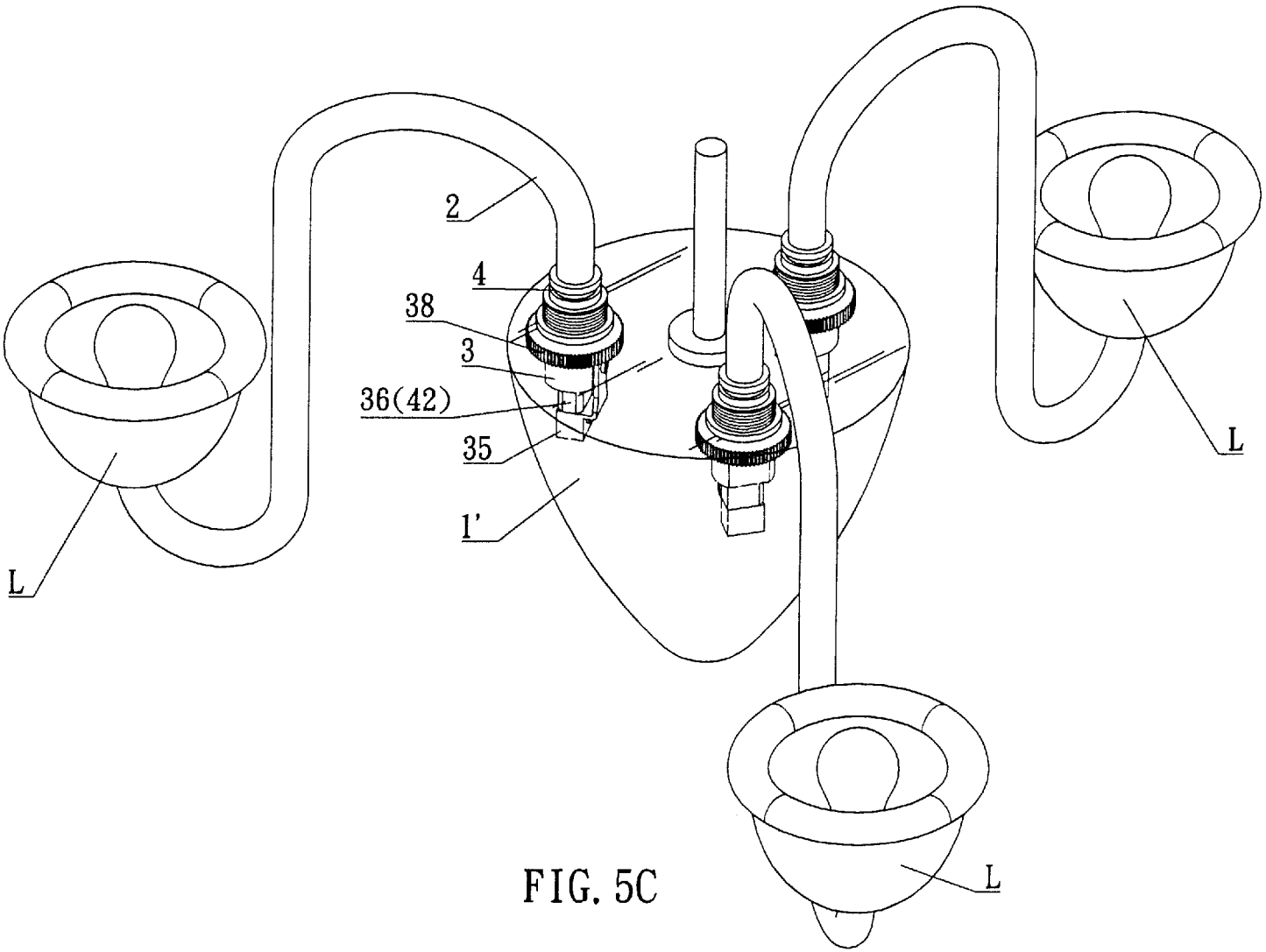
FIG. 5C is an assembled perspective view of the second embodiment of the present invention.

Referring to FIGS. 4A, 5B and SC and FIGS. 1, 1A, 2, 2A, 3 and 3A, when the lamp rod 2 is assembled to an periphery of the lamp seat 1 (referring to FIG. 5A, or the lamp rod 2 is inserted into the lamp seat 1' from the upper side of the lamp seat 1' (referring to FIGS. 5B and 5C, the lamp rod 2 and the inserting sleeves 4 and 4' are combined, then the inserting sleeves 4, 4' are inserted into the retaining sleeves 3 and 3', respectively. Furthermore, the conductive plug or receptacle 36 (42) are connected to one another. Then the fixing nut 45 (referring to FIGS. 1 and 2) or stud 452' (referring to FIG. 3) is used to lock the conductive plug or receptacle. Moreover, as illustrated in FIGS. 4A, 4B and 4C and 5B and 5C, the lamp rod 2 can be engaged with the retaining sleeve 3 or 3' by using the inserting sleeve 4 or 4', respectively. By the eccentric weight of the bubble seat L, the lamp rod 2 can be positioned steadily (referring to FIG. 5C). Furthermore, it can be positioned on the retaining sleeve 3 by the fixing nut 45 so that the lamp seat 1 and lamp rod 2 is separable before being assembled for reducing storage space. They can be assembled rapidly and thus are conductive synchronously.

Figure 6:
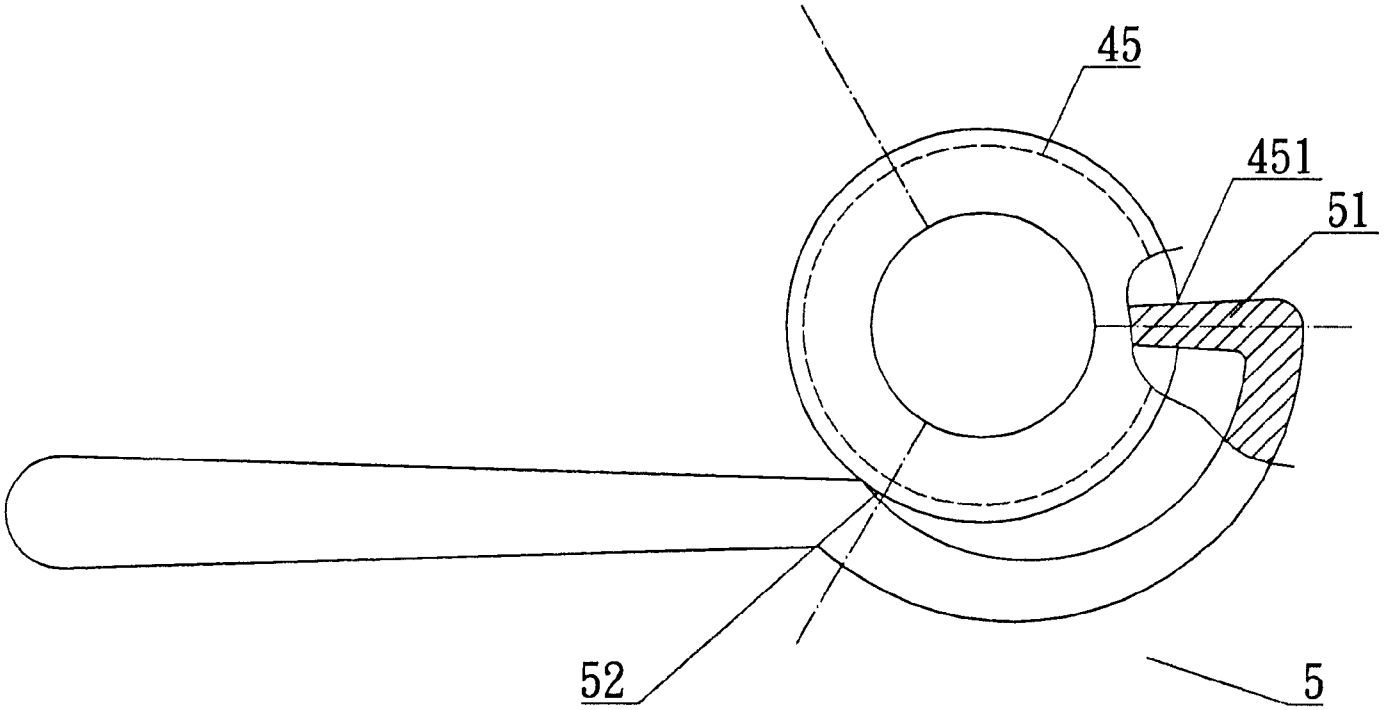
FIG. 6 is a schematic view showing an auxiliary tool for tightening a fixing nut.

Referring to FIGS. 6, 1 and 2, to cause the fixing nut 45 and the retaining sleeve 3 to be tightly engaged, a plurality of auxiliary working holes 453 are formed in the fixing nut 45. Then a hook 51 at a front end of an auxiliary tool 5 is inserted into one of the auxiliary working holes 453 so that the connecting point of the extending portion of the hook 51 is used as a fulcrum to tighten or release the fixing nut 45 so as to protect the surface of the fixing nut 45 and increase the tightness of the fixing nut 45 and the retaining sleeve 3.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lamp connecting device capable of being assembled by users for connecting a lamp seat and a lamp rod of one of a suspending lamp, a wall installed lamp, a table lamp and a ceiling lamp; the lamp seat and lamp rod being detachable so as to have a smaller space for storage; characterized in that:

a lamp seat is formed with a plurality of fixing holes for positioning a plurality of retaining sleeves;

a retaining sleeve being installed to one of a lateral side and an upper side of the lamp seat; the retaining sleeve having threads and having a stop ring or a confining stopper which has an outer diameter larger an outer diameter of said thread, thereby, thereby, the retaining sleeve being locked to a fixing hole by a positioning nut; said retaining sleeve having a polygonal inserting hole;

a retaining seat being engaged to the retaining sleeve, and being positioned at a predetermined position of a rear side of the retaining sleeve; and an inserting sleeve having a rear end connected to the lamp rod; at a connection of the inserting sleeve and the lamp rod being installed with a stepped stop ring for resisting against a fixing nut or an annular trench for confining a stud; a front end of the inserting sleeve being inserted by a conductive plug or a conductive receptacle; an inserted surface of the inserting rod for inserting into the inserting hole of the retaining sleeve having a shape corresponding to a shape of the inserting hole;

wherein the retaining sleeve and inserting sleeve are engaged so that the lamp seat and lamp rod are detachable for being transferred or stored.

2. The lamp connecting device as claimed in claim 1, wherein a middle section of the retaining sleeve has a stop ring and two adjacent sides of the stop ring has front threads and rear threads; the rear threads serves for locking a positioning nut and the front thread serves for locking a fixing nut.

3. The lamp connecting device as claimed in claim 1, wherein at the connection of the inserting sleeve and the lamp rod is installed with a stepped stop ring for resisting against a stepped ring surface at an end surface of the positioning nut, thereby, the inserting sleeve is confined in the retaining sleeve.

4. The lamp connecting device as claimed in claim 1, wherein the connection of the inserting sleeve and the lamp rod is formed with a trench; a threaded hole is formed vertically in the fixing nut; a stud passes through the threaded hole to be in the trench, while the fixing nut is rotatable therein; moreover, the inserting sleeve is tightly engaged in the retaining sleeve.

5. The lamp connecting device as claimed in claim 1, wherein in the front thread, the retaining sleeve is integrally formed with a confining stopper; the stopper is adjacent with the rear trench and the retaining seat having the conductive plug or receptacle.

6. The lamp connecting device as claimed in claim 1, wherein each of the fixing holes have a plurality of grooves and at the stop ring or confining stopper of the retaining sleeve has a plurality of blocks; the blocks are engaged with the grooves so that the retaining sleeve does not rotate.

7. The lamp connecting device as claimed in claim 4, wherein a threaded hole is vertically formed in the confining stopper and a vertical threaded hole is vertically penetrating the confining stopper, thereby, a stud passes through the threaded hole so as to resist against the trench of the inserting sleeve; thereby, the inserting sleeve is fixed therein.

8. The lamp connecting device as claimed in claim 1, wherein an inner edge of the inserted hole of the retaining sleeve and an inserting surface of the inserting sleeve are formed with a plurality of sliding tracks or sliding groove; thereby, when the retaining sleeve and the inserting sleeve respectively are engaged with one another, the retaining sleeves will not rotate.

9. The lamp connecting device as claimed in claim 1, wherein a plurality of auxiliary working holes are formed in the fixing nut; then an auxiliary tool is inserted into one of the auxiliary working holes so that the connecting point of the extending portion of the hook is used as a fulcrum to tighten or release the fixing nut.

10. The lamp connecting device as claimed in claim 9, wherein a hook is formed at a front end of an auxiliary tool; the hook is inserted into one of the auxiliary working holes so that the connecting point of the extending portion of the hook is used as a fulcrum to tighten or release the fixing nut so as to protect the surface of the fixing nut and increase the tightness of the fixing nut and the retaining sleeve.

* * * * *